US005438712A

United States Patent [19]

Hubenthal

[11] Patent Number: 5,438,712

[45] Date of Patent: Aug. 8, 1995

[54] HOT TUB HEATER SYSTEM

[76] Inventor: James N. Hubenthal, 4409 Country Club Dr., Pittsburgh, Pa. 15236

[21] Appl. No.: 104,661

[22] Filed: Aug. 11, 1993

[51] Int. Cl.[6] ..... E04H 4/00

[52] U.S. Cl. ..... 4/493; 126/563; 126/641; 165/142

[58] Field of Search ..... 126/561, 562, 563, 641; 4/493; 165/142

[56] References Cited

U.S. PATENT DOCUMENTS

| | | | |
|---|---|---|---|
| 3,910,490 | 10/1975 | Saypalia, Jr. | 126/563 |
| 4,061,132 | 12/1977 | Ashton et al. | 126/563 |
| 4,240,165 | 12/1980 | Kyrias | 4/493 |
| 4,293,323 | 10/1981 | Cohen | 165/142 |
| 4,313,428 | 2/1982 | Goldenberg | 126/563 |
| 4,326,499 | 4/1982 | Koskela | 126/641 |
| 4,574,875 | 3/1986 | Rawlings et al. | 165/142 |
| 4,718,130 | 1/1988 | Steinback | 4/493 |
| 4,823,771 | 4/1989 | Menning | 126/563 |
| 4,926,830 | 5/1990 | McNelley | 165/142 |
| 5,208,923 | 5/1993 | Stiver | 4/493 |

*Primary Examiner*—Henry C. Yuen
*Attorney, Agent, or Firm*—Patrick Garrett

[57] ABSTRACT

The present invention is a hot tub heater system. The hot tub heater system is comprised of a hot tub having water within. The hot tub heater system is also comprised of means for heating the water within the hot tub. The heating means comprises a hot water heater which heats a body of water within a tank and means for transferring heat from the water within the tank to the water of the hot tub without any intermixing. Preferably, the heat transferring means comprises a piping assembly which acts as a heat exchanger. The piping assembly can be a variety of different forms. The present invention allows a hot tub to be heated inexpensively with a domestic hot water heater.

3 Claims, 7 Drawing Sheets

HOT TUB HEATER SYSTEM

FIELD OF THE INVENTION

The present invention is related in general to the heating of hot tubs. More specifically, the present invention is related to a system for heating a hot tub using a domestic hot water heater.

BACKGROUND OF THE INVENTION

The energy cost associated with the operation of a hot tub can raise energy bills an alarming amount For instance, it is common for a hot tub within a 60 degree F. environment to require 40,000 BTU's per day to maintain its water at a temperature of 100 degrees F. If electricity is used to supply the heat, the cost would be over $26/month (based on a rate of 10 cents per kilowatt hour and 1 kilowatt=3400 BTUs). In winter, hot tub electrical heating costs can exceed $100/month!

Gas is typically is many times cheaper than electricity for equivalent heating. Heating a hot tub needing 40,000 BTUs/day with gas would cost only $9/month (assuming a rate of 0.6 cents/cubic foot, 1 cubic foot =1030 BTUs and 75% efficiency). Thus in an effort to curb hot tub heating expenses there have been developed hot tub heaters which use gas to heat the water. However, conventional gas fired hot tub heaters present their own problems. For instance, they are very expensive at a typical retail price exceeding $1000. Also, they require their own gas line and a substantial amount of room. Quite simply, the complexity and expense of conventional gas or oil fired hot tub heaters prevent their use in most situations.

The present invention discloses a hot tub heater which utilizes a typical domestic hot water heater. The invention eliminates the need for installation of a separate and redundant gas fired device with the associated problems of space requirements, maintenance, fuel supply, safety, etc.

SUMMARY OF THE INVENTION

The present invention is a hot tub heater system. The hot tub heater system is comprised of a hot tub having water within. The hot tub heater system is also comprised of means for heating the water within the hot tub. The heating means comprises a hot water heater which heats a body of water within a tank and means for transferring heat from the water within the tank to the water of the hot tub without any intermixing. Preferably, the heat transferring means comprises a piping assembly which acts as a heat exchanger. The piping assembly can be a variety of different forms.

Preferably, the heat transferring means comprises a first conduit for transferring water from the hot tub to the piping assembly, a second conduit for transferring water from the piping assembly back to the hot tub and means for pumping water from the hot tub to the piping assembly through the first conduit and back to the hot tub through the second conduit. The pumping means can be the existing pump/filter system of the hot tub with the first and second conduits fluidically connected to the appropriate pipes of the pump/filter system. Or if desired a pump can be provided in one of the fluid conduits for providing enhanced flow. The pump can be connected to the thermostat system of the hot tub so that when the hot tub needs heat, the pump is activated to circulate water through the piping assembly. The piping assembly has an input and an output. The first conduit is fluidically connected to the input while the second conduit is fluidically connected to the output.

In one embodiment, the inlet and the outlet are disposed in a spaced relationship on the hot water heater with a length of tubing extending through the hot water heater there between.

Alternatively, the piping assembly can be comprised of a closed piping loop having a first pipe having a first open end and a second pipe having a closed first end. The first pipe is disposed coaxially within the second pipe so that the closed piping loop can access then hot water heater through only a single port.

In yet another embodiment, the piping assembly is comprised a closed tube having the inlet and the outlet and a tubing loop through which water from the hot water heater circulates through. The tubing loop extends through the tube in a sealed manner therewith such that heat can be transferred through the tubing loop between the water of the hot water tank and the water of the hot tub circulating through the tube. Preferably, the tubing loop comprises a pump for circulating water there through.

DESCRIPTION OF THE PREFERRED EMBODIMENT

Figure 1:
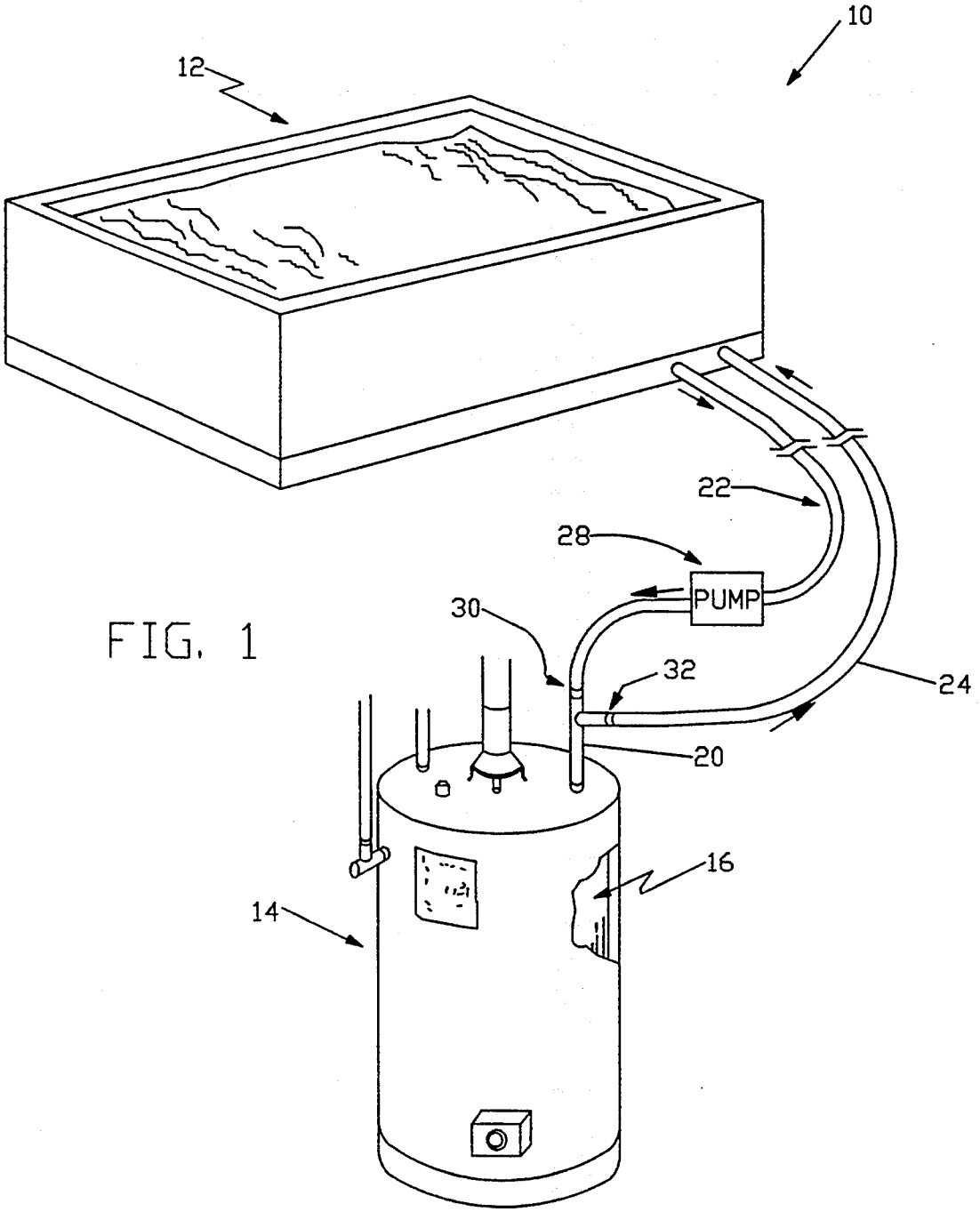
FIG. 1 is a schematic representation showing the present invention.

Referring now to the drawings wherein like reference numerals refer to similar or identical parts throughout the several views and more specifically to FIG. 1 thereof there is shown a hot tub heater system 10. The system 10 is comprised of a hot tub 12 having water within. The heater system 10 is also comprised of means for heating the water within the hot tub. The heating means comprises a hot water heater 14 which heats a body of water within a and means 18 means for transferring heat from the water within the tank 16 to the water of the hot tub 12 without any intermixing. The heat transferring means 18 is in fluidic communication with the hot tub 12 and the hot water heater 14. Preferably, the heat transferring means 18 comprises a piping assembly 20 which acts as a heat exchanger. It should be appreciated that the piping assembly 20 can be a variety of different forms as will be discussed in the following.

Figure 5:
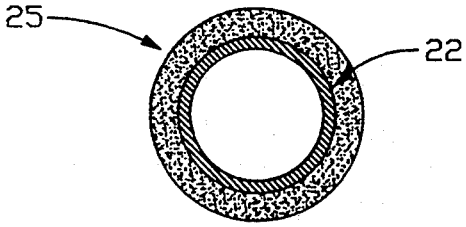
FIG. 5 is a schematic representation showing a conduit with insulation.

Preferably, the heat transferring means 18 comprises a first conduit 22 for transferring water from the hot tub 12 to the piping assembly 20, a second conduit 24 for transferring water from the piping assembly 20 back to the hot tub 12 and means for pumping water from the hot tub 12 to the piping assembly 20 through the first conduit 22 and back to the hot tub 12 through the second conduit 24. The pumping means can be the existing pump/filter system of the hot tub 12 with the first and second conduits 22,24 fluidically connected to the appropriate pipes of the pump/filter system. Or if desired a pump 26 can be provided in one of the fluid conduits 22,24 for providing enhanced flow. The pump 28 can be connected to the thermostat system of the hot tub 12 so that when the hot tub 12 needs heat, the pump 28 is activated to circulate water through the piping assembly 20. The piping assembly 20 has an input 30 and an output 32. The first conduit 22 is fluidically connected to the input 30 while the second conduit 24 is fluidically connected to the output 32. Preferably, as shown in FIG. 5, there is insulation 25 disposed about the conduits 22,24.

Figure 2:
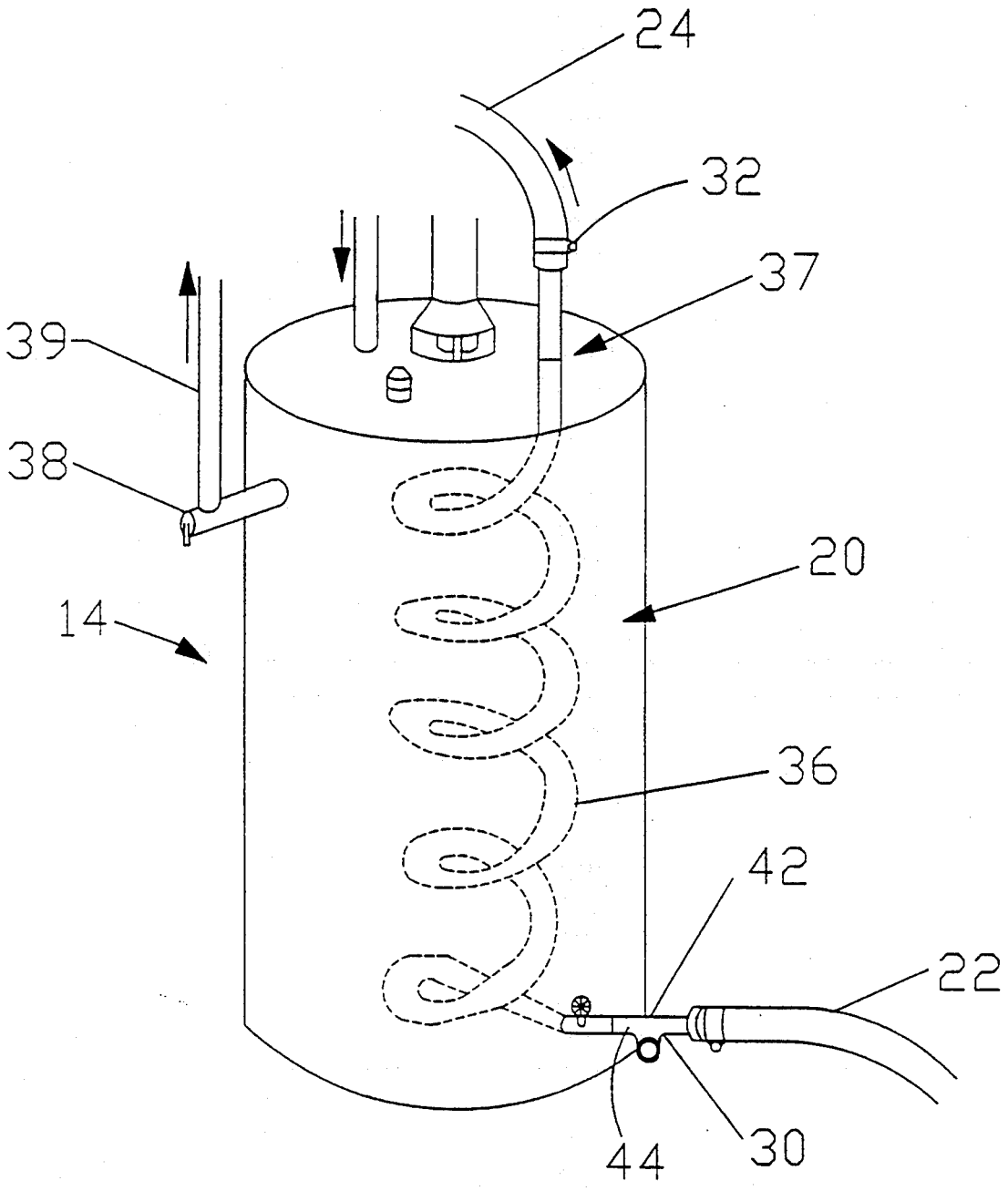
FIG. 2 is a schematic representation showing one embodiment of the piping assembly.

As shown in FIG. 2, the inlet 30 and the outlet 32 can be disposed in a spaced relationship on the hot water heater 14 with a length of tubing 36 extending through the hot water heater 14 there between. For instance, the tubing 36 can be coiled into turns in the hot water heater 14 so as to have a maximum heat transfer length. The outlet 32 of the piping assembly 20 can be disposed through the port 37 of the hot water heater 14 which is typically used as the hot water outlet. In turn, the hot water outlet 39 of the hot water heater 14 can be moved and incorporated, by way of a T- fitting 38, into the conventional safety relief valve port 40. The inlet 30 can be incorporated into the conventional drain 42 of the hot water heater 14 with a T-fitting 44 having a valve. Though other piping arrangements can be used.

Figure 3:
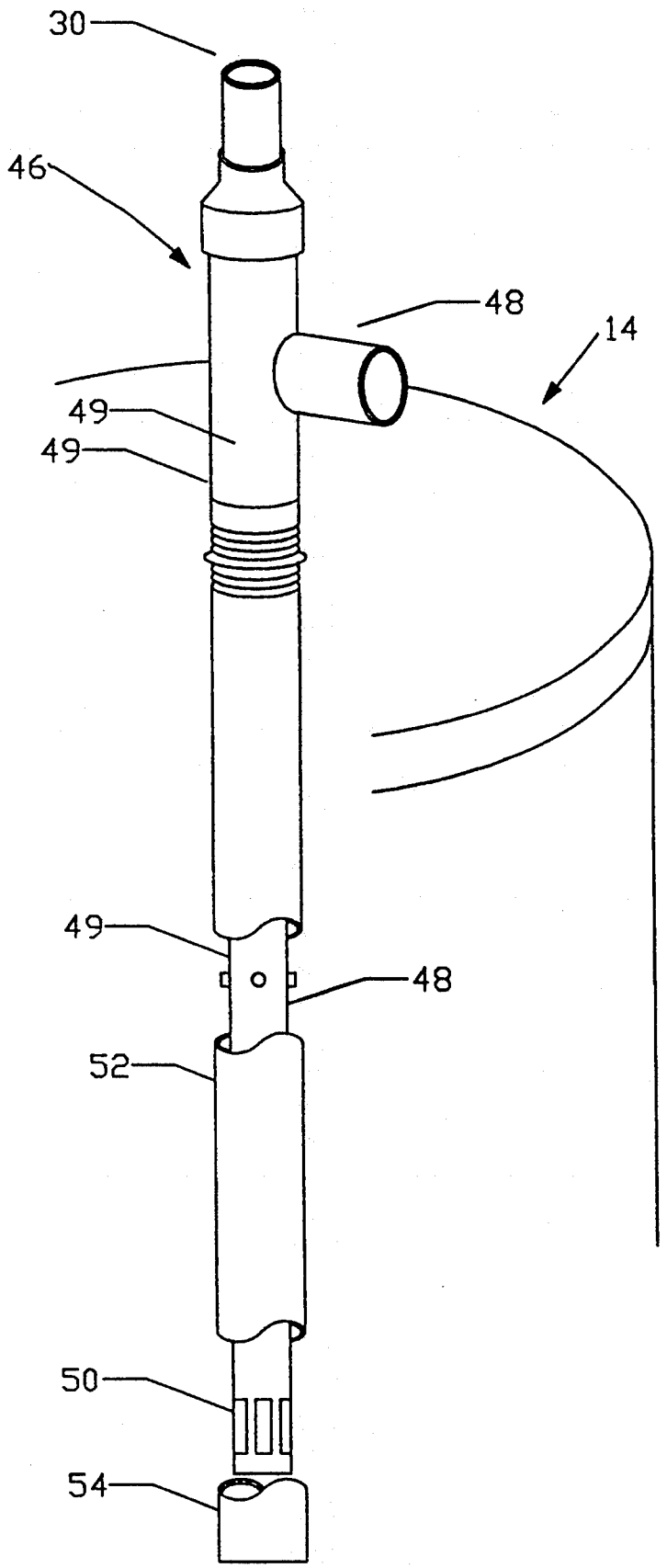
FIGS. 3 is a schematic representation showing another embodiment of the piping assembly.

Alternatively, as shown in FIG. 3, the piping assembly 20 can be comprised of a closed piping loop 46 having a first pipe 48 having a first open end 50 and a second pipe 52 having a closed first end 54. The first pipe 48 is disposed coaxially within the second pipe 52 so that the closed piping loop 46 can access then hot water heater 14 through only a single port.. The inlet 30 and outlet 32 are in fluidic communication with the second ends of the first and second pipes 48,52.

Preferably, the inlet 30 is connected to the inner pipe 48 and the outlet 32 is connected to the outer pipe 52 so that the water from the hot tub 12 flows through the inner pipe 48 downward, out through the open end 50, up through the outer pipe 48 gaining heat and back to the hot tub 12. Though it should be appreciated that the inlet 30 and outlet 32 can be reversed.

Figure 6:
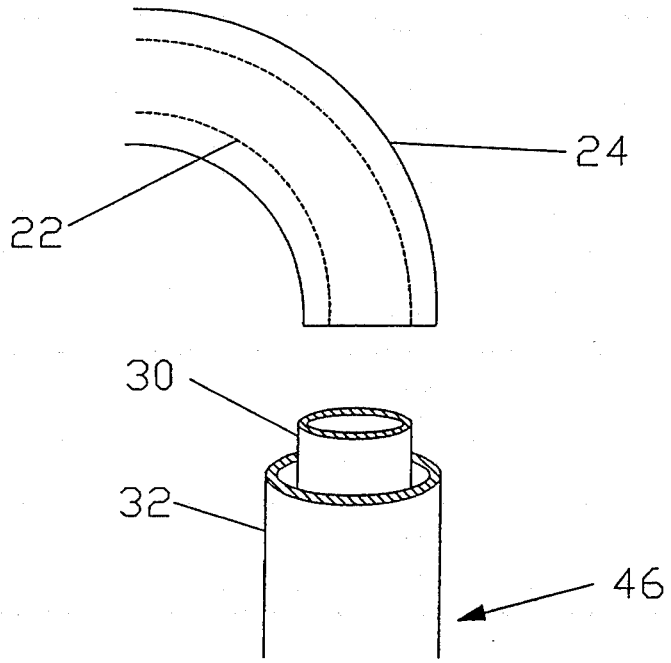
FIG. 6 is as schematic representation showing coaxial piping for connection to coaxial conduits.

To ensure correct spacing the inner pipe 48 can have spacing tabs 49 to maintain the inner pipe 48 away from the outer pipe 52. In one embodiment as shown in FIG. 3, the closed piping loop 46 is comprised of a T assembly 56 defining the inlet 30, the outlet 32 and a port 58. The second pipe 52 is connected to the port 58 while the first pipe 48 extends through the port 58. In another embodiment, as shown in FIG. 6, the inlet 30 and the outlet 32 are coaxial for joining to coaxially disposed first and second 22,24.

Figure 4A:
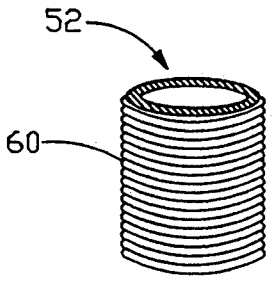
FIGS. 4*a*–4*c* are schematic representations showing different embodiments of the outer tube.
Figure 4B:
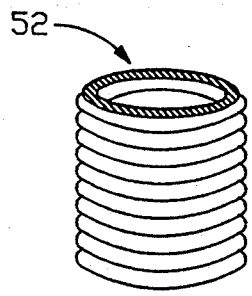
Figure 4C:
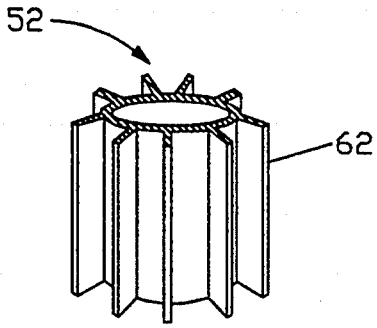

In order to provide an increased area for heat transfer the outer pipe 52 can be comprised of a plurality of raised ridges, such as threading 60 on the outside of the pipe, as shown in FIG. 4*a*. Alternatively, as shown in FIG. 4*b*, the outer pipe 52 can be comprised of corrugated piping. Alternatively, as shown in FIG. 4*c*, the outer pipe 52 can be comprised of a plurality of raised fins 62.

Figure 7:
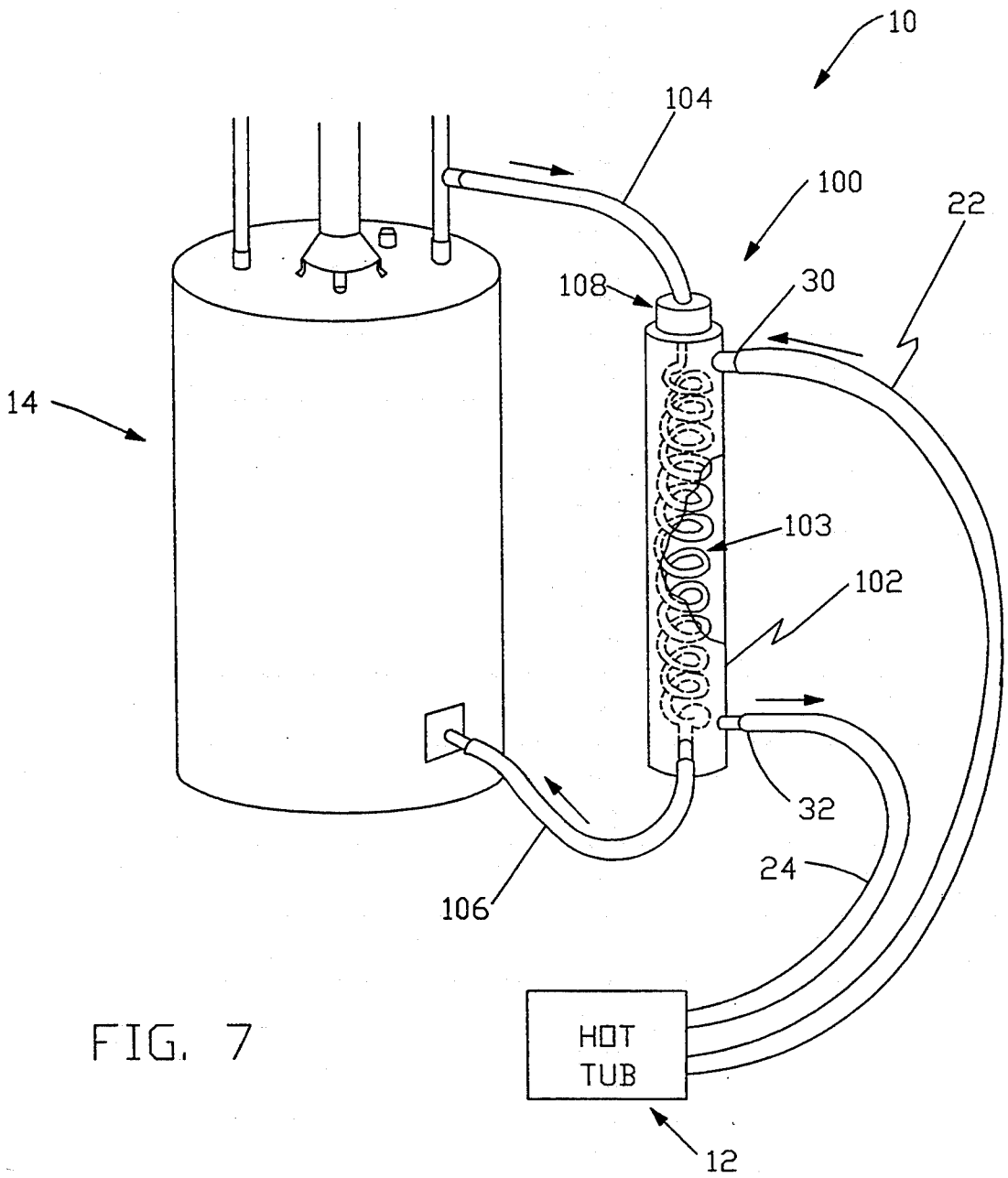
FIG. 7 is a schematic representation showing another embodiment of the piping assembly

In yet another embodiment and as shown in FIG. 7, the piping assembly 20 is comprised a closed tube 102 having the inlet 30 and the outlet 32 and a tubing loop 103 through which water from the hot water heater 14 circulates through. The tubing loop 103 extends through the tube 102 in a sealed manner therewith such that heat can be transferred through the tubing loop 102 between the water of the hot water tank 14 and the water of the hot tub circulating through the tube 102. Preferably, the tubing loop 103 comprises a pump 108 for circulating water there through. Though it should be appreciated that the water from the hot water tank 14 can be circulated through the tubing loop 103 with a gravity feed setup with the hot water rising to the tube 102 and falling as it is cooled. The portion of the tubing loop within the tube 102 can be any variety of shapes, such as a coil which is known to have excellent heat transfer surface.

Figure 8:
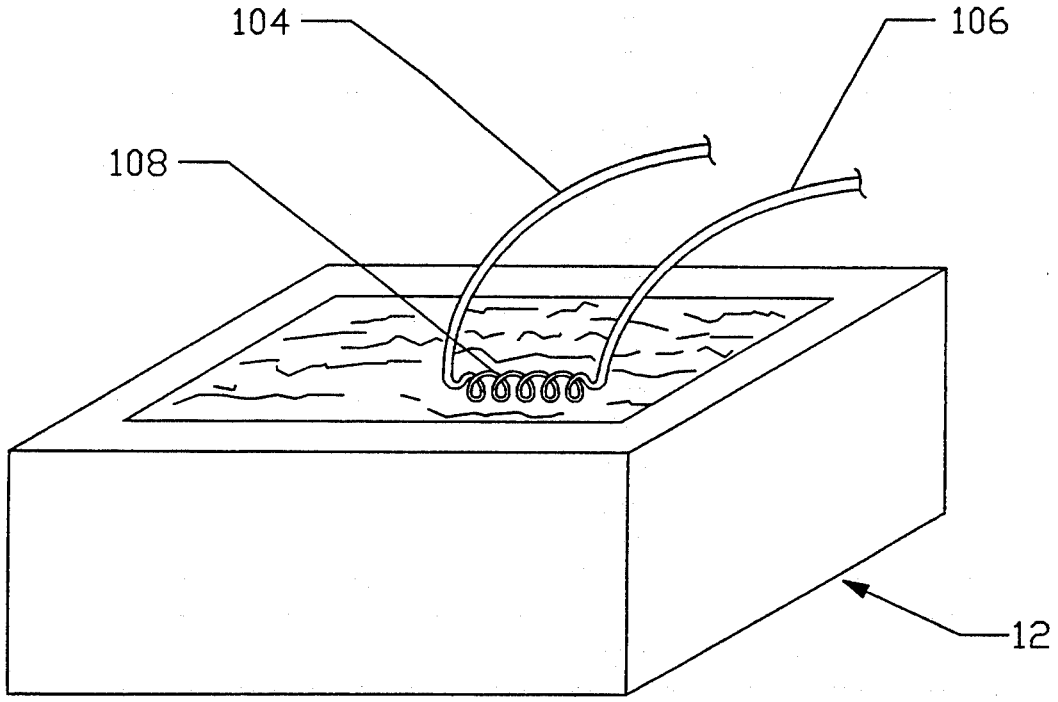
FIG. 8 is a schematic representation showing another embodiment of the piping assembly with a tubing loop circulating water from the hot water heater inserted directly into the water of the hot tub.

Also, as shown in FIG. 8, the tube 102 can be eliminated and the tubing loop 103 can be disposed directly into the water of the hot tub 12. Increased heat transfer can be induced by turning the jets or bubbles of the hot tub 12 on to cause the water within the hot tub 12 to circulate.

The present invention is also a method of heating a hot tub 12. The method comprises the step of connecting a piping assembly 20 to a hot water heater 14. Then there is the step of circulating water of the hot tub 12 about the piping assembly 20 such that heat is transferred between water within the hot water tank 14 and water within the hot tub 12 without any intermixing thereof.

In a more general sense, the present invention is a heat exchange apparatus 200 which Comprises a first reservoir 12 containing a first fluid and a second reservoir 14 containing a second fluid. The heat exchange apparatus 200 also comprises means 18 for transferring heat between the fluid within the first reservoir 12 and the fluid of the second reservoir 14 without any intermixing. Preferably, the heat transferring means 18 comprises a piping assembly 20 which acts as a heat exchanger. The piping assembly 20 can be any of the variety of forms discussed previously.

For instance, as described previously, in one embodiment the first reservoir is comprised of a hot tub 12 and the second reservoir is comprised of a hot water heater 14. However it should be appreciated that the heat exchange apparatus 200 can be used for a variety of purposes besides a hot tub. For instance the heat exchanger 200 can be used to provide heat to pools, jetted bathtubs, aquariums and hot beds. The heat exchange apparatus 200 can also be used to preheat water for cooking, to remove the chill of cold water for hand washing, to heat water for beverages or to heat dishwasher water. The heat exchange apparatus 200 can be also used to provide heated water for space heating a dwelling or a closed loop system can be placed in a driveway to melt snow and ice. Although the invention has been described in detail in the foregoing embodiments for the purpose of illustration, it is to be understood that such detail is solely for that purpose and that variations can be made therein by those skilled in the art without departing from the spirit and scope of the invention except as it may be described in the following claims.

I claim:

1. A hot tub heater system comprising:

a hot tub having water within; and means for heating the water within the hot tub, said heating means comprised of a hot water heater which heats a body of water within a tank and means for transferring heat from the water within the tank to the water of the hot tub without any intermixing thereof, said heat transfer means in fluidic communication with the hot tub and the hot water heater, said heat transfer means comprising a piping assembly which acts as a heat exchanger, said heat transfer means comprising a first conduit for transferring water from the hot tub to the piping assembly, a second conduit for transferring water from the piping assembly back to the hot tub and means for pumping water from the hot tub to the piping assembly through the first conduit and back to the hot tub through the second conduit, said piping assembly comprised of an input and an output, said first conduit fluidically connected to the input, said second conduit fluidically connected to the output, said piping assembly comprising a closed tube having the inlet and the outlet and a tubing loop through which water from the hot water heater circulates through, said tubing loop extending through the tube in a sealed manner therewith such that heat can be transferred through the tubing loop between the water of the hot water tank and the water of the hot tub circulating through the tube, said tubing loop comprising of a plurality of raised ridges to increase the surface area thereof for more effective heat transfer.

2. A hot water heater system as described in claim 1 wherein the raised ridges are defined by threading on the second pipe.

3. A hot water heater system as described in claim 1 wherein the raised ridges are defined by a plurality of fins disposed on the second pipe.

* * * * *